US007000587B1

(12) United States Patent
Hawkins

(10) Patent No.: US 7,000,587 B1
(45) Date of Patent: Feb. 21, 2006

(54) SYSTEM FOR CHANGING A SELECTED ENGINE FUNCTION BASED ON SENSED WEATHER CONDITIONS

(75) Inventor: Jeffery S. Hawkins, Farmington Hills, MI (US)

(73) Assignee: Detroit Diesel Corporation, Detroit, MI (US)

( * ) Notice: Subject to any disclaimer, the term of this patent is extended or adjusted under 35 U.S.C. 154(b) by 0 days.

(21) Appl. No.: 10/996,920

(22) Filed: Nov. 24, 2004

(51) Int. Cl.
*F02D 75/02* (2006.01)

(52) U.S. Cl. ..... 123/320

(58) Field of Classification Search ..... 123/320, 123/322, 323
See application file for complete search history.

(56) References Cited

U.S. PATENT DOCUMENTS

| | | | | |
|---|---|---|---|---|
| 4,542,325 | A | 9/1985 | Kobayashi et al. | |
| 5,777,451 | A | 7/1998 | Kobayashi et al. | |
| 5,929,534 | A | 7/1999 | Pickett | |
| 6,059,686 | A * | 5/2000 | Takahashi | 477/47 |
| 6,109,027 | A * | 8/2000 | Schaefer | 60/324 |
| 6,216,667 | B1 * | 4/2001 | Pekar | 123/320 |
| 6,307,198 | B1 | 10/2001 | Asakura et al. | |
| 6,409,289 | B1 | 6/2002 | Wagner et al. | |
| 6,470,731 | B1 | 10/2002 | Rieth | |
| 6,580,385 | B1 | 6/2003 | Winner et al. | |

OTHER PUBLICATIONS

E. Silva, MBE4000-Turbo Brake-Operation, Detroit Diesel, No. 03 TS-40, Aug. 29, 2004, pp. 1-9.
DDEC IV Application and Installation, 4.26 PasSmart, 1999, pp. 4-203-4-204.
Vaisala, DRD11A Rain Detector, pp. 1-3.
Detroit Diesel, Engine Brakes Available—For Detroit Diesel Series 60, MBE900 and MBE4000 Engines.

* cited by examiner

*Primary Examiner*—Mahmoud Gimie
(74) *Attorney, Agent, or Firm*—Brooks Kushman P.C.

(57) ABSTRACT

A system for modifying or disabling a selected engine function in response to a determination based upon a precipitation sensor input that precipitation is present. The system also may include an ambient temperature sensor that determines whether the ambient temperature is below a predetermined level. Signals from the precipitation sensor and temperature sensor are provided to an engine controller. The engine controller functions to modify or disable a selected engine function such as a compression brake, engine exhaust brake, maximum speed calibration or passing speed variance calibration.

14 Claims, 3 Drawing Sheets

SYSTEM FOR CHANGING A SELECTED ENGINE FUNCTION BASED ON SENSED WEATHER CONDITIONS

BACKGROUND OF THE INVENTION

1. Field of the Invention

The present invention relates to a system for disabling or modifying an engine function to accommodate sensed weather conditions.

2. Background Art

Engines, such as compression ignition engines, use an engine controller that controls nearly every aspect of engine operation. Complex algorithms are incorporated in the engine control system that modify engine operation based upon inputs from sensors, data tables, and the like. Engine control systems optimize engine performance to maximize fuel economy and reduce engine emissions. Control algorithms may be used to control engine power output. Engine control systems may be specified by fleet managers to control operation of a fleet of vehicles to assure that drivers operate the vehicles in a safe and efficient manner.

Weather conditions may impact vehicle operation. Specifically, precipitation, such as rain, sleet or snow, may change desired driving patterns. For example, a safe driving speed for a dry road may be excessive if it is raining. Further, temperature may affect driving when roads are wet or covered with ice and snow. Wet or ice covered roads may make it desirable to limit vehicle speed and availability of engine braking systems.

Prior art engine controllers are not generally provided with information regarding precipitation. Further, while prior engine controls have had ambient temperature inputs, these temperature inputs were not used to control selected engine functions, such as engine braking or speed control, based upon weather conditions.

Fleet managers and prudent vehicle operators realize that fuel economy may be improved by limiting the maximum vehicle speed. However, in some instances, vehicle operators require the ability to exceed vehicle speed limitations temporarily for passing or when traveling over hilly terrain.

Engine braking systems have been developed to supplement or complement conventional vehicle brakes. One type of engine brake is a compression brake that functions by causing the exhaust valve to open prematurely near the end of the compression stroke. This causes air pressure from the cylinder to be released before its energy is returned to the crankshaft during the power stroke. As a result, the engine functions similar to an air compressor and can slow the vehicle down. Another type of engine brake is an exhaust brake. Exhaust brakes are located in the exhaust system downstream of the turbocharger. Exhaust brakes restrict the flow of exhaust gases out of the engine. Pressure builds up in the exhaust system so that when the piston expels gases from the cylinder during the exhaust stroke, exhaust gases must push against that pressure. This restriction in the exhaust system absorbs horsepower and can slow the vehicle down.

There is a need for a system that overrides engine calibrations based upon a determination that a vehicle is operating in an environment where precipitation is present and, in particular, where precipitation is present and ambient temperatures are below a predetermined level where ice and snow may be present on a road surface.

The present invention is directed to solving the above problems and fulfilling the needs described above.

SUMMARY OF THE INVENTION

According to one aspect of the present invention, a system for controlling an engine for a vehicle is provided that permits modification of engine control based upon an output signal from a precipitation sensor. The system includes an engine controller that is responsive to a plurality of sensors that control engine operation. At least one of the sensors is a precipitation sensor that determines whether precipitation is present and generates a signal that is received by the controller. The controller modifies a selected engine function in response to receiving the signal from the precipitation sensor.

According to other aspects of the invention, the system may modify operation of an engine brake. The engine brake works through motion transfer using a master/slave piston arrangement which opens cylinder exhaust valves near the top of the normal compression stroke, releasing the compressed cylinder charge to exhaust. The blowdown of compressed air to atmospheric pressure prevents the return of energy to the engine piston on the expansion stroke. The effect is a net energy loss, since the work done in compressing the cylinder charge is not returned during the expansion stroke. Operation of a compression engine brake may be disabled in response to receiving a signal from the precipitation sensor. Operation of an exhaust brake may be disabled by preventing the restriction flow of exhaust gases from the engine during an exhaust stroke.

According to other aspects of the invention, engine operation may be modified by reducing the maximum allowable speed limit. In an engine that has a maximum allowable speed limit calibration, a passing speed variance calibration may be provided that permits temporarily exceeding the maximum allowable speed limit calibration. Engine operation may be modified by disabling the passing speed variance calibration or reducing the allowable passing speed for passing time.

According to another aspect of the present invention, a system for controlling an engine brake for a vehicle is provided. The system includes an engine controller and a precipitation sensor that determines whether the precipitation is present and generates a first signal that is received by the controller. A temperature sensor may be used to determine whether the ambient temperature is below a predetermined level and generates a second signal that is received by the controller. The controller may be calibrated to inhibit operation of the engine brake in response to receiving the first signal from the precipitation sensor and the second signal from the temperature sensor.

According to other aspects of the invention, the engine brake may be a compression engine brake, an exhaust engine brake or a turbocharger brake. Further, the system may comprise an operator perceptible warning indicator that is actuated when the controller inhibits operation of the engine brake.

According to another aspect of the present invention, a system for controlling an engine calibration corresponding to a speed rating for a vehicle is provided. The system comprises an engine controller and a precipitation sensor that determines whether precipitation is present and generates a precipitation signal that is received by the controller. The controller modifies the speed rating in response to receiving the precipitation signal from the precipitation sensor.

According to other aspects of the invention, the system may also comprise a temperature sensor that determines whether the temperature is below a first predetermined level and generates a low temperature signal. A controller may then modify the speed rating only if the low temperature signal and precipitation signal are both received by the controller. The speed rating may be a maximum allowable speed limit calibration. The controller may also have a passing speed variance calibration that permits temporarily exceeding the maximum allowable speed limit calibration. Engine operation may be modified by disabling the passing speed variance calibration. The system may further comprise a temperature sensor that determines whether the temperature is below a first predetermined level and may generate a low temperature signal wherein the controller modifies the passing speed variance calibration only if the low temperature signal and precipitation signal are both received by the controller. An operator perceptible indicator may be actuated when precipitation is sensed.

These and other aspects of the present invention will be better understood in view of the attached drawings and the following detailed description of the invention.

DETAILED DESCRIPTION OF THE PREFERRED EMBODIMENT(S)

Figure 1:
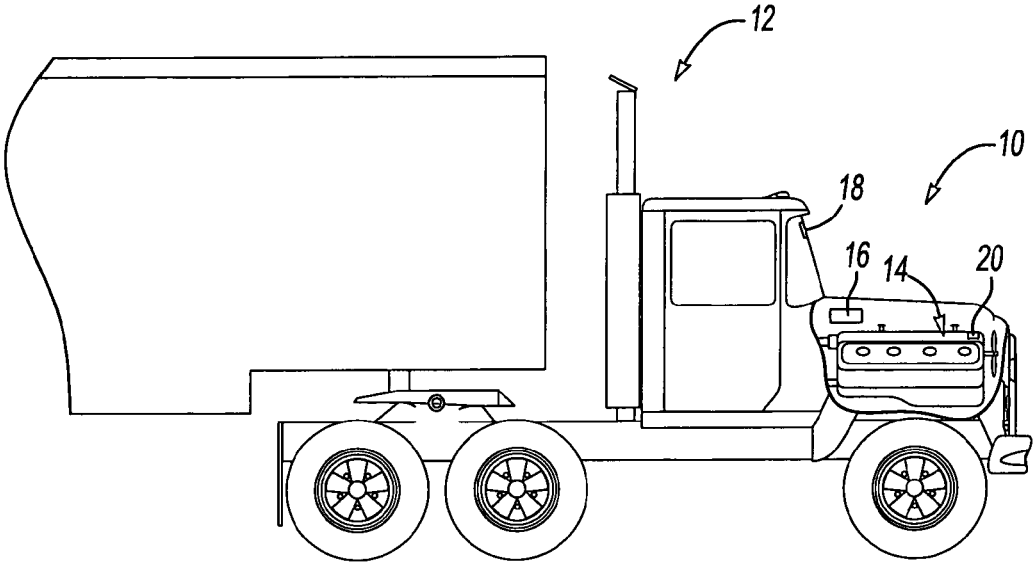
FIG. 1 is a diagrammatic view of a vehicle having an engine that is provided with sensors and a control module in accordance with the present invention.

Referring to FIG. 1, the component parts of a system for modifying engine calibrations is generally indicated by reference numeral 10. A vehicle 12 having a compression ignition engine 14 is illustrated diagrammatically. An engine control module 16 controls operation of the engine 14 in accordance with programmed instructions, or algorithms, that control nearly every aspect of the engine operation. A precipitation sensor 18 is provided on the vehicle 12 in a location suitable for the sensor to detect the presence of precipitation such as rain, sleet or snow. A temperature sensor 20 is provided on the vehicle 12 or engine 14 for sensing the ambient air temperature. The temperature sensor 20 may be a dedicated temperature sensor that is used solely for the system of the present invention or may be a temperature sensor that is provided for other purposes on the vehicle. The precipitation sensor 18 and temperature sensor 20 are connected to the engine control module 16 to provide the signals to the engine control module 16 as will be more fully described below.

Figure 2:
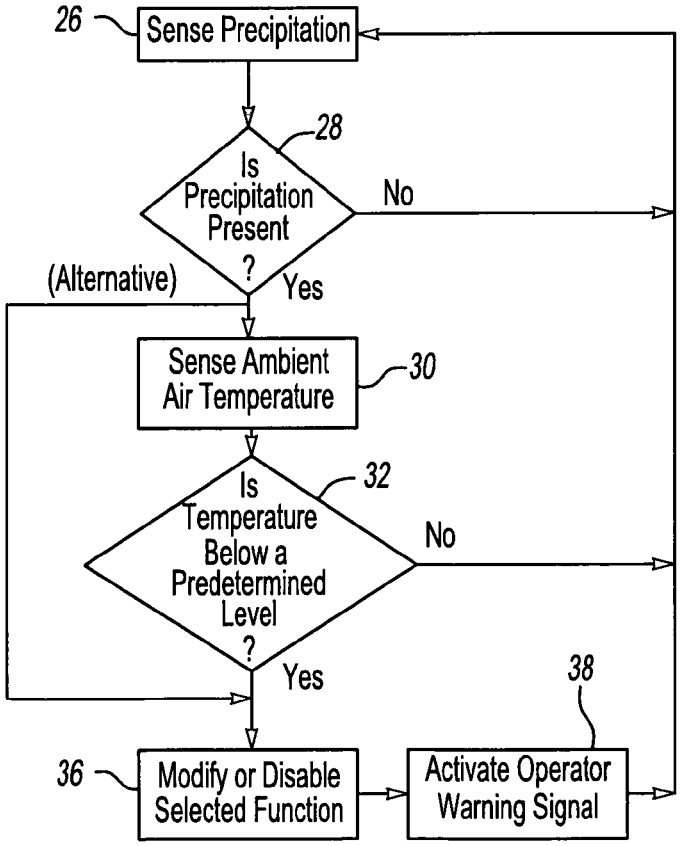
FIG. 2 is a flowchart showing a system for modifying or disabling a selected engine function according to the present invention.

Referring to FIG. 2, an algorithm 24 for modifying or disabling selected engine functions that interfaces with the algorithm of the engine control module 16 is illustrated. The first step in the algorithm 24 is indicated as sensing precipitation, at 26. The algorithm determines, at 28, whether precipitation is present. If so, the algorithm may then sense temperature, at 30, and determine whether the ambient temperature is below a predetermined level, at 32. If so, the algorithm 24 may then modify or disable a selected engine function, at 36. If the selected engine function is modified or disabled, an operator warning signal may be activated, at 38, to indicate to the driver that the given engine function has been modified or disabled. The warning signal may be a light or audible alarm.

As an alternative, if it is determined that precipitation is present at 28, the algorithm may proceed directly to modify or disable a selected engine function, at 36, without determining whether the ambient temperature is below the predetermined level.

If it is determined that no precipitation is present, the system returns to the step of sensing precipitation, at 26. Similarly, if precipitation is present and the ambient temperature is above the predetermined level, at 32, the algorithm may return to the step of sensing precipitation, at 26.

If a selected engine function is modified or disabled at 36, the warning light is also activated at 38 and the engine returns to continue to sense the presence of precipitation at 26. While not shown, it should be understood that a delay timer may be incorporated in the algorithm 24 to prevent hysteresis or unwanted cycling of the algorithm 24 at times when precipitation is minimal or intermittent.

In the step of modifying or disabling a selecting engine function, the system causes the engine control module 16 to change the engine operation in comparison to normal engine operation. The selected engine function may be compression braking, exhaust braking or turbocharger braking that will be described below in reference to FIGS. 3 and 4.

Figure 3:
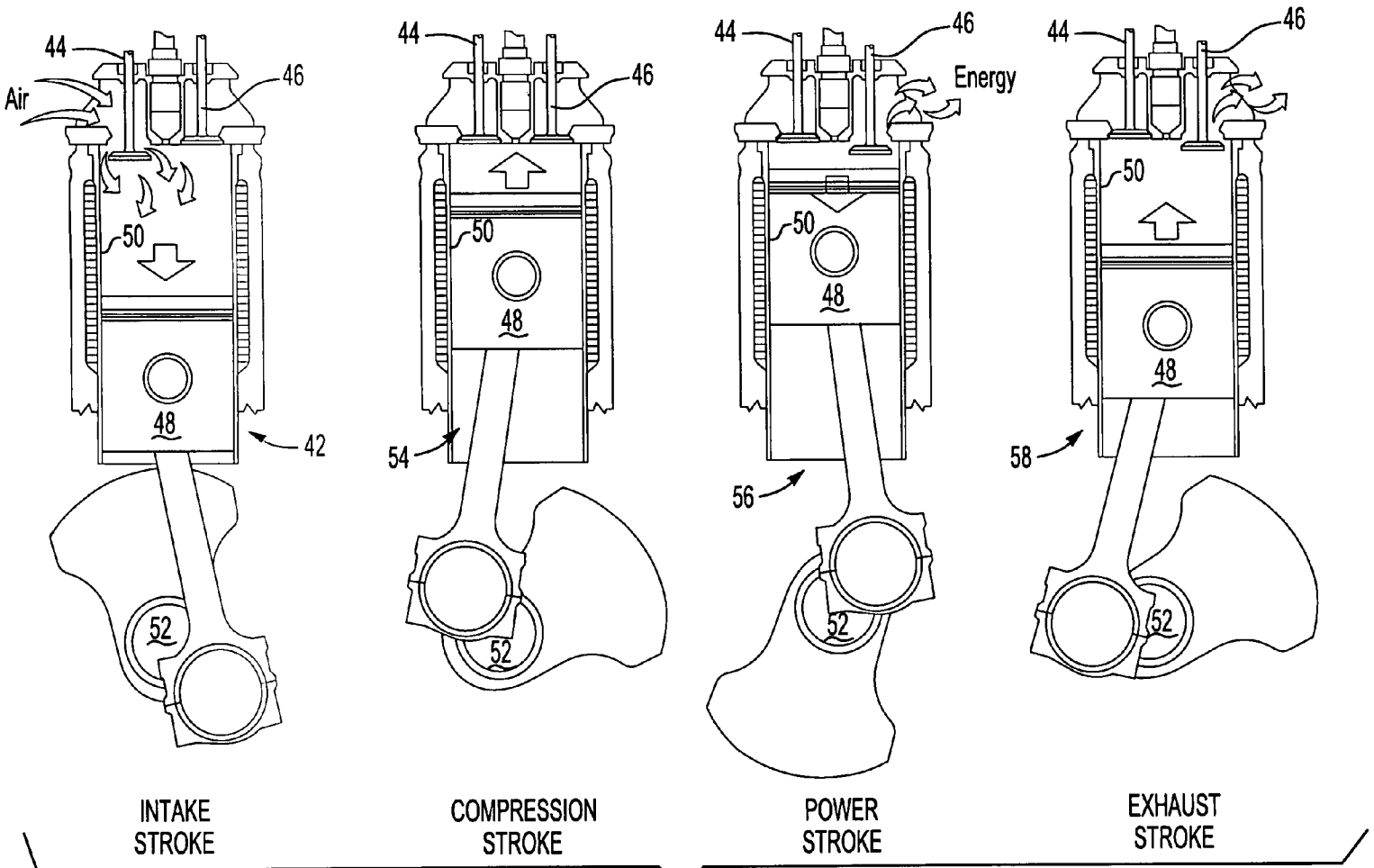
FIG. 3 is a sequential view of a compression ignition engine cylinder showing each of the four strokes and operation in a compression brake mode.

Referring to FIG. 3, a four stroke compression emission engine 40 is shown diagrammatically wherein the four strokes are illustrated in sequential views. The intake stroke is shown at 42 wherein an intake valve 44 is opened while an exhaust valve 46 is closed. The piston 48 is shown being pulled downwardly in a cylinder 50 to draw air through the open intake valve 44. On the compression stroke, the piston is driven upwardly, as shown in FIG. 3, to compress air and fuel within the cylinder in the compression stroke 54. In the power stoke 56, the piston 48 is again drawn downwardly in the cylinder 50 by the crankshaft 52 while the exhaust valve 46 is open. This causes the engine to act as an air compressor since the expanding gasses in the cylinder at the time of combustion are ported through the exhaust valve 46 thereby limiting the power produced in the power stroke 56. In the exhaust stroke 58 exhaust gasses are expelled through the exhaust valve 46 as the piston 48 moves upwardly through the cylinder 48. According to one embodiment of the invention, the engine controller module 16 may disable the compression brake function if precipitation is sensed or if both precipitation and a low ambient air temperature are sensed.

Figure 4:
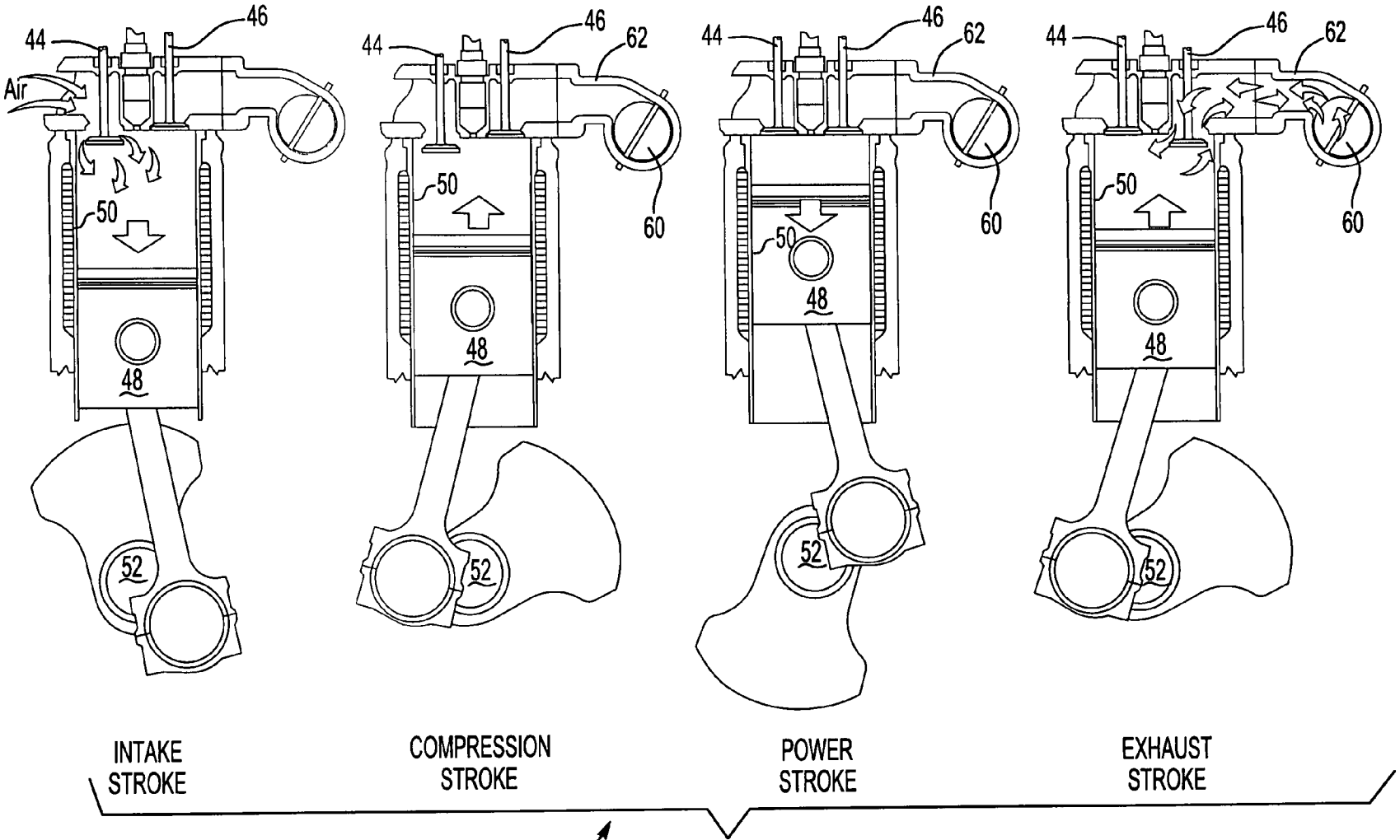
FIG. 4 is a sequential view of a compression ignition engine cylinder showing each of the four strokes and operation in an exhaust brake mode.

Referring to FIG. 4, compression engine 40 is diagrammatically shown again in full view to illustrate operation of the engine 40 to provide an exhaust brake function. The description of the intake stroke 42 and compression stroke 54 are the same as described above with reference to FIG. 3 and will not be repeated here for brevity. In the power stroke 56, the piston 48 moves downwardly in the cylinder 50 transferring power from the combustion of fuel and gasses in the cylinder 50 and providing that power to the crankshaft 52. An exhaust brake valve 60 is provided in the exhaust system 62. The exhaust brake valve 60 is closed by the engine control module 16 when the operator or engine control module requests exhaust braking. The exhaust brake valve 60 is closed to restrict the flow of exhaust through the exhaust system 62 causing it to return during the exhaust stroke. The return of exhaust gasses to the cylinder create a braking force on the engine operation. According to another embodiment of the invention, the engine control module 16 may disable the exhaust brake function under the same conditions noted above with reference to FIG. 3.

Another embodiment of the invention could be adapted for use with a turbo brake. A turbo brake is a type of engine brake that provides engine braking by reducing the radial passage for exhaust gas flow and the incidence angle of the exhaust gases against the turbine. This increases turbine speed and increases boost pressure that enhances the engine braking effect. The turbo brake has a sliding sleeve in the exhaust housing, an electronic proportional valve (or a variable drive for the waste gate valve) and a constant throttle valve. If precipitation is sensed, the engine controller can modify the turbo brake function by either disabling it entirely or by reducing its function to a lower braking stage level.

The selected engine function could also be a modification of the maximum vehicle speed set point. For example, if the engine is calibrated to prevent operation above 60 miles per hour under normal operating conditions, an algorithm in the present invention could modify the calibration limiting maximum engine speed to, for example, 40 miles per hour if precipitation is determined to be present and the ambient temperature is determined to be below the predetermined level. In another exemplary embodiment of the present invention, the algorithm 24 could be used to modify a passing speed variance calibration. In some engines, the maximum allowable speed limit is calibrated by the engine control module and a time limited or temporary passing speed variance calibration is provided that permits temporarily exceeding the maximum allowable speed limit calibration. The algorithm may function to disable the passing speed variance calibration or modify it by reducing the level of the passing speed variance calibration.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A system for controlling an engine for a vehicle, comprising:

an engine controller responsive to a plurality of sensors that controls engine operation;

wherein at least one of the sensors is a precipitation sensor that determines whether precipitation is present and generates a signal that is received by the controller;

wherein the controller disables an engine brake in response to receiving the signal from the precipitation sensor.

2. The system of claim 1 wherein the engine brake is disabled by the controller preventing the opening of at least one exhaust valve during a power stroke of the engine cycle releasing compressed air from the engine during the power stroke.

3. The system of claim 1 wherein the engine operation is modified by disabling an engine brake by preventing the restriction of a flow of exhaust gases from the engine during an exhaust stroke.

4. A system for controlling an engine for a vehicle, comprising:

an engine controller responsive to a plurality of sensors that controls engine operation;

wherein at least one of the sensors is a precipitation sensor that determines whether precipitation is present and generates a signal that is received by the controller;

wherein the controller reduces a maximum allowable speed limit calibration of the engine in response to receiving the signal from the precipitation sensor.

5. The system of claim 4 wherein the engine has a passing speed variance calibration that permits temporarily exceeding the maximum allowable speed limit calibration, wherein the engine operation is modified by disabling the passing speed variance calibration.

6. A system for controlling an engine brake for a vehicle, comprising:

an engine controller;

a precipitation sensor that determines whether precipitation is present and generates a first signal that is received by the controller;

a temperature sensor that determines whether the ambient temperature is below a predetermined level and generates a second signal that is received by the controller; and wherein the controller prevents operation of the engine brake in response to receiving both the first signal from the precipitation sensor and the second signal from the temperature sensor.

7. The system of claim 6 wherein the engine brake operates by opening at least one exhaust valve during a power stroke of the engine cycle releasing compressed air from the engine during the power stroke.

8. The system of claim 6 wherein the engine brake operates by restricting a flow of exhaust gases from the engine during an exhaust stroke.

9. The system of claim 6 further comprising an operator perceptible warning indicator that is actuated when the controller prevents operation of the engine brake.

10. A system for controlling an engine calibration corresponding to a speed rating for a vehicle, comprising:

an engine controller;

a precipitation sensor that determines whether precipitation is present and generates a precipitation signal that is received by the controller;

the controller modifying the speed rating in response to receiving the precipitation signal from the precipitation sensor.

11. The system of claim 10 further comprising an operator perceptible indicator that is actuated when the precipitation signal is received by the controller.

12. The system of claim 10 further comprising a temperature sensor that determines whether the temperature is below a first predetermined level and generating a low temperature signal, wherein the controller modifies the speed rating only if the low temperature signal and precipitation signal are both received by the controller.

13. The system of claim 10 wherein the speed rating is a maximum allowable speed limit calibration and wherein the controller has a passing speed variance calibration that permits temporarily exceeding the maximum allowable speed limit calibration, wherein the controller disables the passing speed variance calibration.

14. The system of claim 13 further comprising a temperature sensor that determines whether the temperature is below a first predetermined level and generating a low temperature signal, wherein the controller disables the passing speed variance calibration only if the low temperature signal and precipitation signal are both received by the controller.

* * * * *